US006625288B1

(12) United States Patent
Koizumi

(10) Patent No.: US 6,625,288 B1
(45) Date of Patent: Sep. 23, 2003

(54) COLLAPSING PARABOLOID DISH AND METHOD

(75) Inventor: David H. Koizumi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/540,049

(22) Filed: Mar. 31, 2000

(51) Int. Cl.[7] ..... H04R 25/00

(52) U.S. Cl. ..... 381/160; 381/356; 181/178; 367/151

(58) Field of Search ..... 381/160, 356; 181/178; 367/151; 343/915, 916

(56) References Cited

U.S. PATENT DOCUMENTS 3,176,303 A * 3/1965 Holland ..... 343/915
3,699,576 A * 10/1972 Hoyer ..... 343/915
3,715,760 A * 2/1973 Palmer ..... 343/915
3,895,188 A * 7/1975 Ingraham ..... 381/160
4,899,167 A * 2/1990 Westphal ..... 343/915
5,198,832 A * 3/1993 Higgins et al. ..... 343/915

* cited by examiner

*Primary Examiner*—Curtis Kuntz
*Assistant Examiner*—Suhan Ni
(74) *Attorney, Agent, or Firm*—Schwegman, Lundberg, Woessner & Kluth, P.A.

(57) ABSTRACT

A paraboloid receiving dish having a base, a receiver coupled to the base, and a plurality of petals pivotably connected to the base. The petals are moveable between an open position and a closed position with each of the positions forming a reflector having a parabolic shape.

31 Claims, 9 Drawing Sheets

COLLAPSING PARABOLOID DISH AND METHOD

BACKGROUND OF THE INVENTION

The present invention concerns receiving dishes, particularly paraboloid dishes used to receive sound and radio signals, such as microphones and RF antennae.

Receiving dishes are generally single piece paraboloid shaped dishes. They are generally shallow in depth to allow for easier manufacture and shipping. However, shallow dishes are susceptible to stray signals from sources positioned to the sides of the receiving dish. Alternatively, deeper one piece dishes reduce the stray signal problem but the cost to manufacture, package, and ship a one piece deep parabolic dish is unwieldy and expensive.

Present dishes also include folding umbrella type receiving dishes. These are generally used in low-gravity space applications. These dishes consist of a skeleton with a flexible cloth-like covering. These dishes are functional only when fully open, requiring set up before the dish is operational.

There are at least two problems with these receiving dishes. First, a deep dish with good selectivity with low stray signal interference has a high cost of manufacture and shipping. Second, umbrella-type folding dishes only operate when in the fully open position. Third, these present dishes are not adjustable in diameter or depth, nor is the gain of the receiver adjustable by adjusting the diameter and depth of the receiver. Thus, there is a need for a collapsible parabolic dish that is deeper in depth that allows easier manufacture and shipping. There is also a need for a collapsible parabolic dish that is operable in both the open and closed position and has an adjustable diameter and depth and an adjustable gain.

DETAILED DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

To address these needs, one exemplary embodiment of a receiving dish includes a base, a receiver coupled to the base, and a plurality of petals pivotably connected to the base. The petals are moveable between an open position and a closed position, each of the positions forming a reflector having a parabolic shape.

Advantageously, the receiving dish is a collapsible deep paraboloid dish that allows for easier manufacture and shipping. The collapsible parabolic dish is operable in both the open and closed position and has an adjustable diameter and depth and adjustment of the gain of the receiver.

Figure 1:
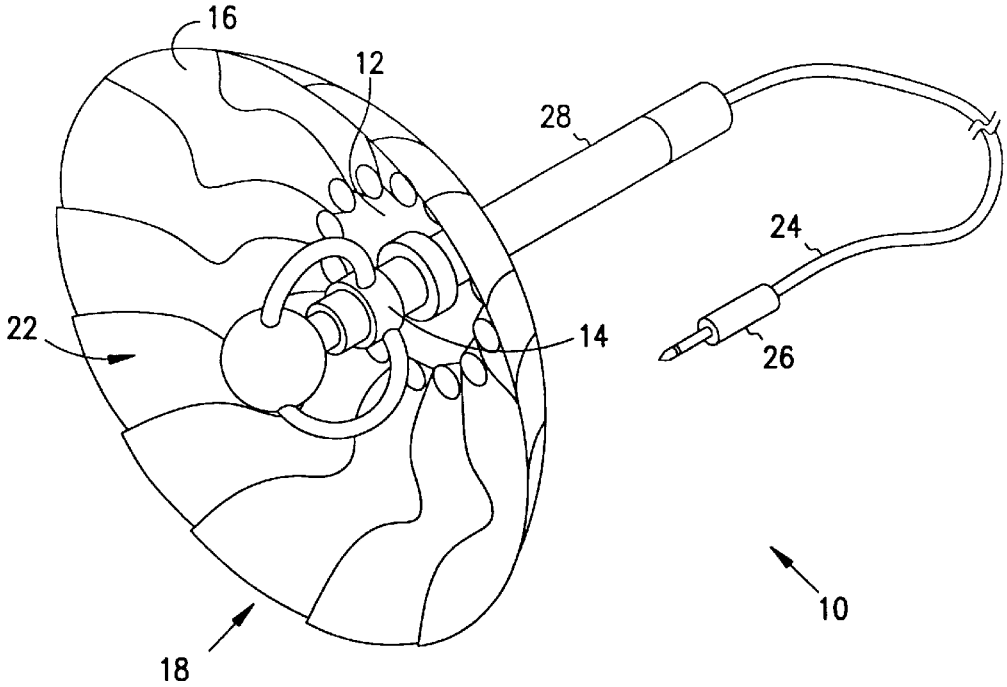
FIG. 1 is a perspective view of one embodiment of a collapsible paraboloid dish in an open position.

FIG. 1 shows an exemplary receiving dish 10, such as an acoustical receiving dish. Receiving dish 10 has a base 12, a receiver 14 coupled to base 12, and a plurality of petals 16. Each petal 16 pivotably connects to base 12 and moves between an open position 18 and a closed position 20 (See FIG. 3 and FIG. 4). Base 12 and plurality of petals 16 form a first reflector 22 in open position 18. The receiver 14 is shown as a microphone, but alternatively receiver 14 is any receiver of energy focused by receiving dish 10, such as sound or electrical energy. Receiver 14 is a boundary layer reflector microphone that concentrates the acoustic waves against a surface forming a high pressure boundary layer yielding a 3 dB increase in sensitivity. Receiver 10 connects to a cable 24 and a jack 26 for connection to another device (not shown). Cable 24 passes through handle 28.

Figure 2:
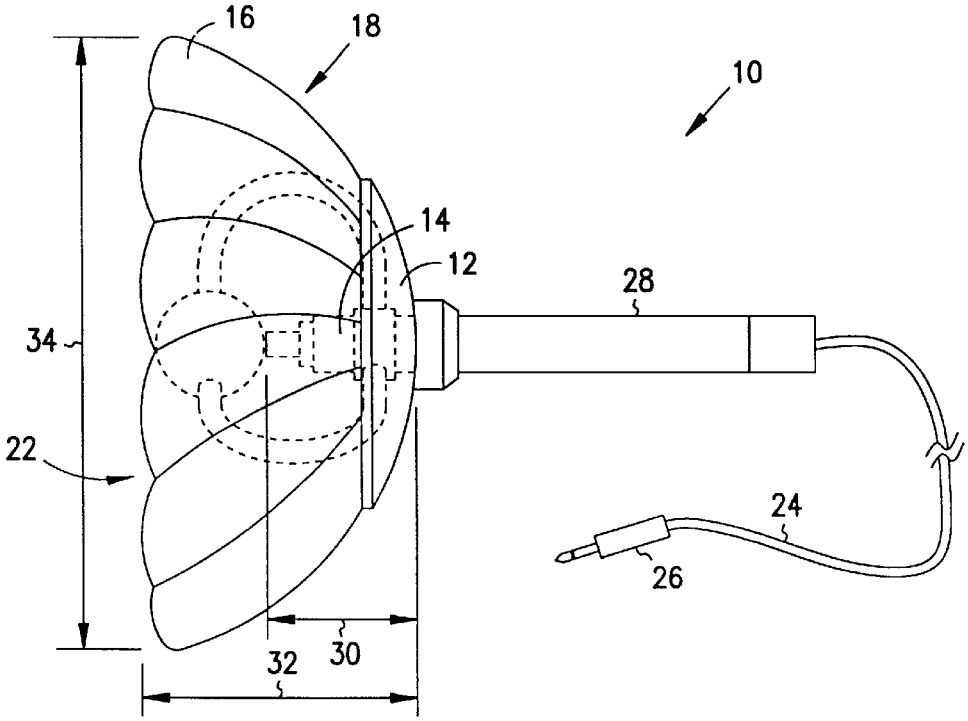
FIG. 2 is a cross sectional side view of one embodiment of a collapsible paraboloid dish in an open position.

FIG. 2 shows a cut away side view of an exemplary receiving dish 10. First reflector has an open focal depth 30, a open depth 32, and an open diameter 34. Receiving dish 10 preferably has a high selectivity. High selectivity is obtained by placing receiver 14 at focal depth 30 deep within first reflector 22. Open depth 32 is preferably equal to or greater than open focal depth 30 so that receiving dish 10 provides better selectivity. The shape of a parabolic receiving dish is commonly described using the ratio of focal depth to diameter. The ratio of focal depth to diameter is 0.25 for a parabola having a focal depth equal to the depth. Receiving dish 10 preferably has a ratio of open focal depth 30 to open diameter 34 equal to or greater than 0.25.

Figure 3:
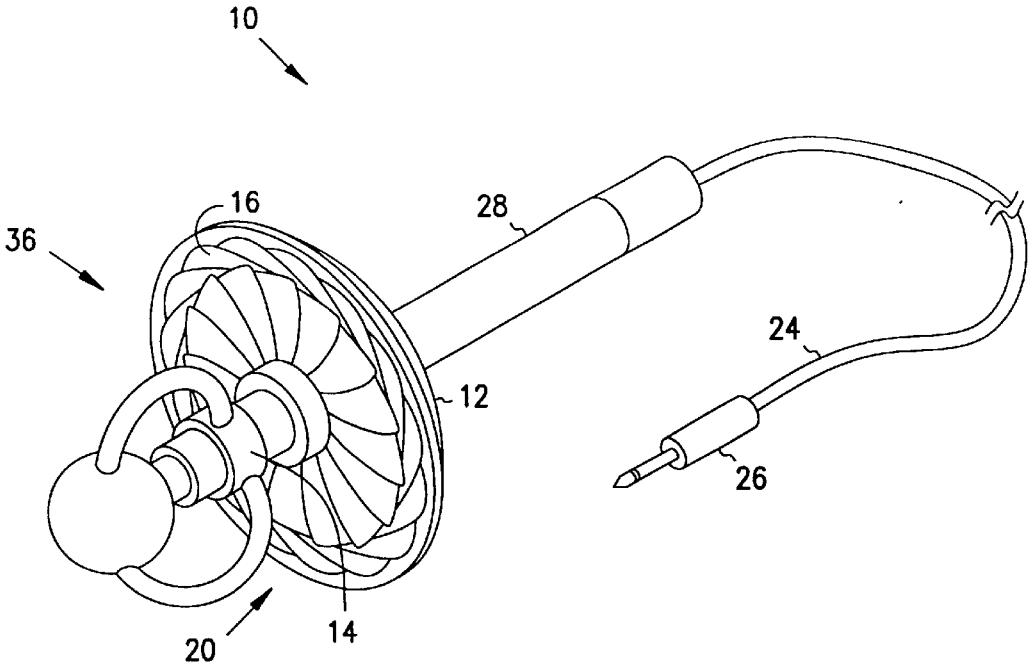
FIG. 3 is a perspective view of one embodiment of a collapsible paraboloid dish in a closed position.

FIG. 3 shows an exemplary receiving dish 10 in a closed position 20. Plurality of petals 16 are pivoted approximately 180 degrees from open position 18 to closed position 20 forming a second reflector 36. In open position 18 each petal 16 extends outwardly from base 12. In closed position 20 each of the petals 16 are positioned across base 12. Each of the petals 16 are semi-rigid or slightly flexible so that they bend to fit the curve of base 12 as they are rotated from open position 18 to closed position 20. The petals 16 are resilient so that as the petals 16 move from the closed position 20 to the open position 18 they return to their original shape.

Figure 4:
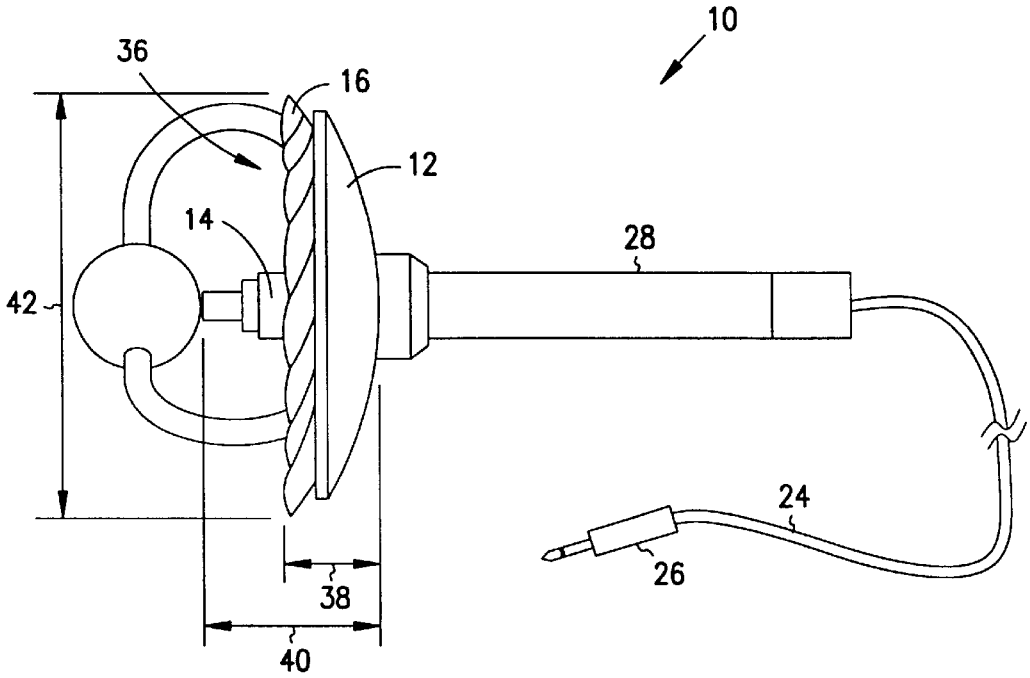
FIG. 4 is a cross sectional side view of one embodiment of a collapsible paraboloid dish in a closed position.

FIG. 4 shows a side view of exemplary receiving dish 10 in the closed position forming second reflector 36. Second reflector 36 has a closed focal depth 38, a closed depth 40 and a closed diameter 42. Second reflector 36 has a ratio of closed focal depth to closed diameter equal to or less than 0.25. Alternatively, the ratio may be greater than 0.25, depending on the needed selectivity in the closed position.

Figure 5:
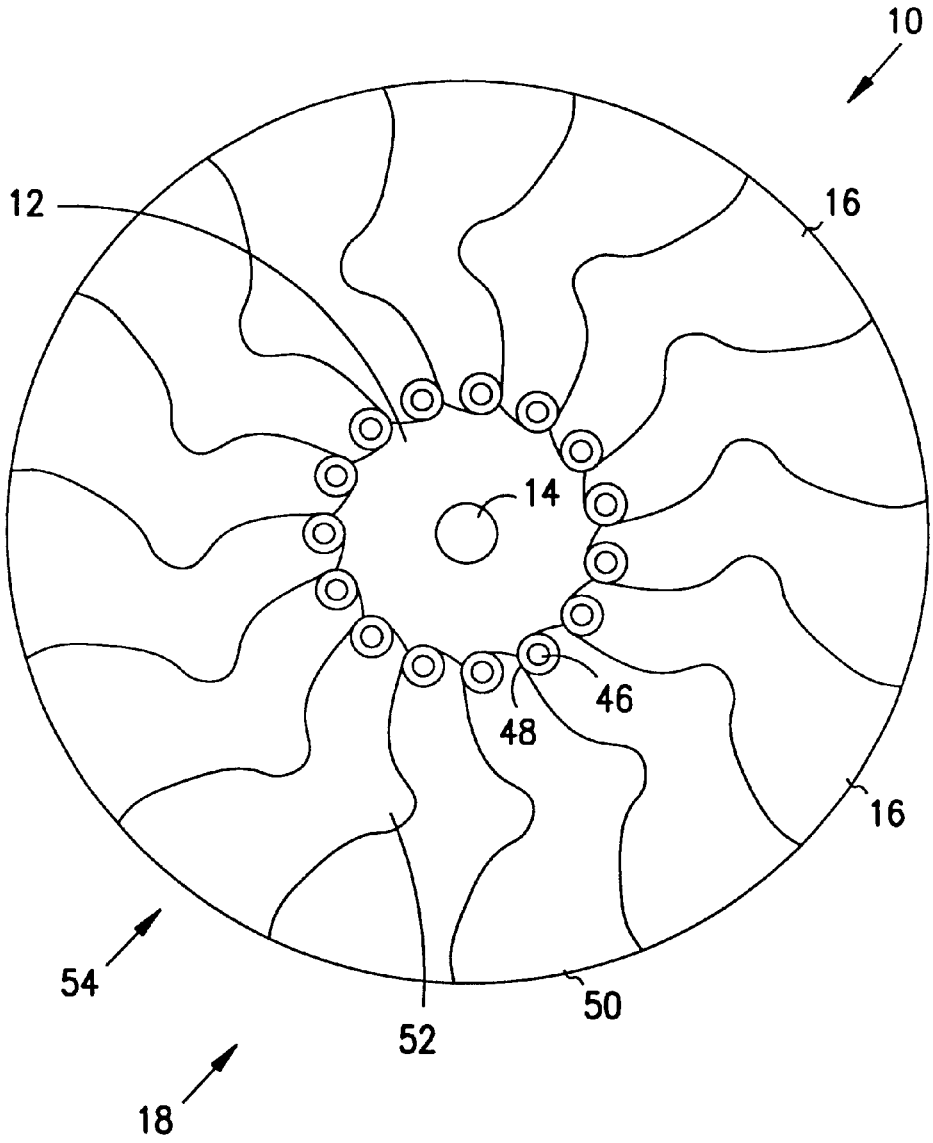
FIG. 5 is a side front view of one embodiment of a collapsible paraboloid dish in a fully open position.
Figure 6:
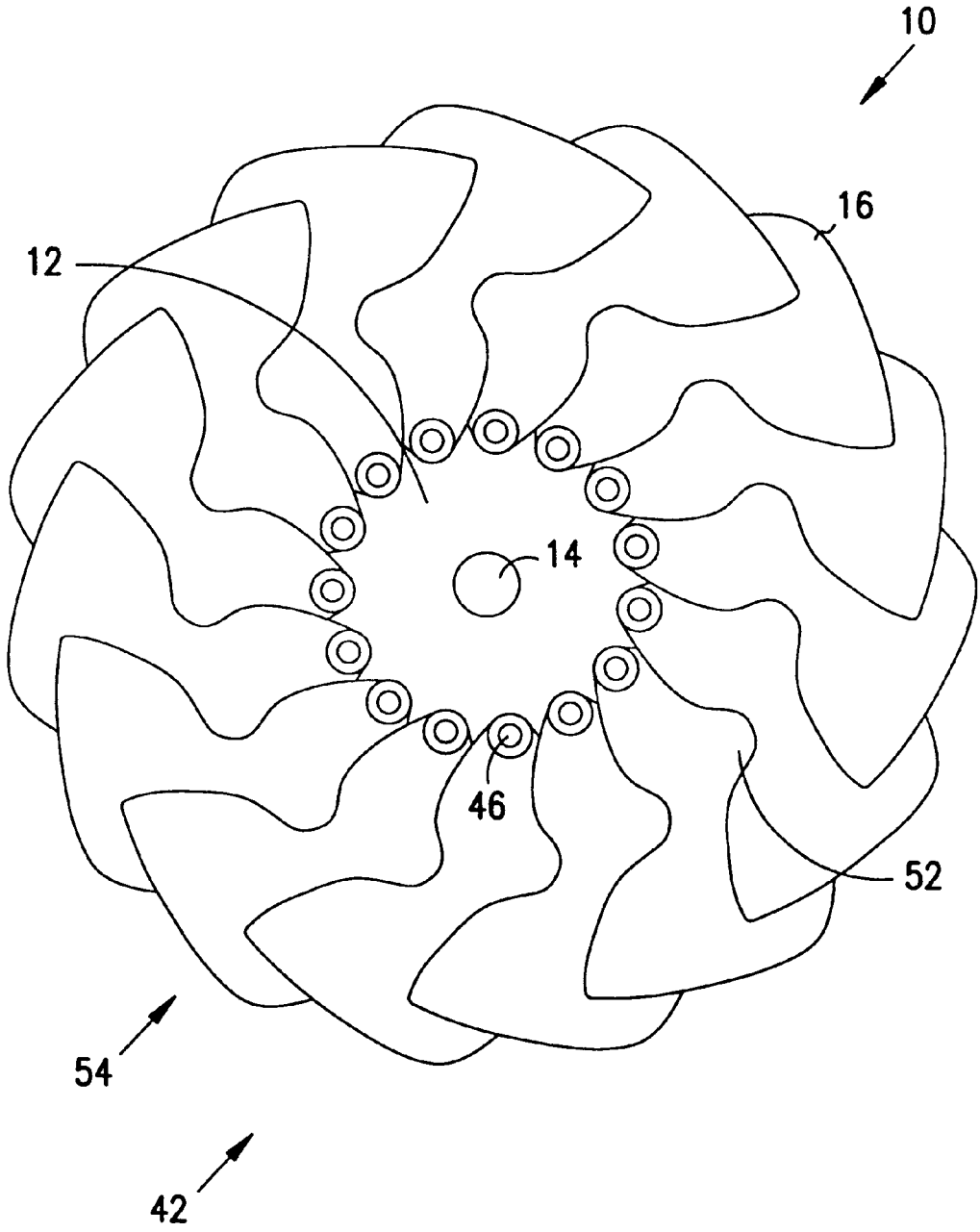
FIG. 6 is a side front view of one embodiment of a collapsible paraboloid dish in a an first intermediate partially open position.
Figure 7:
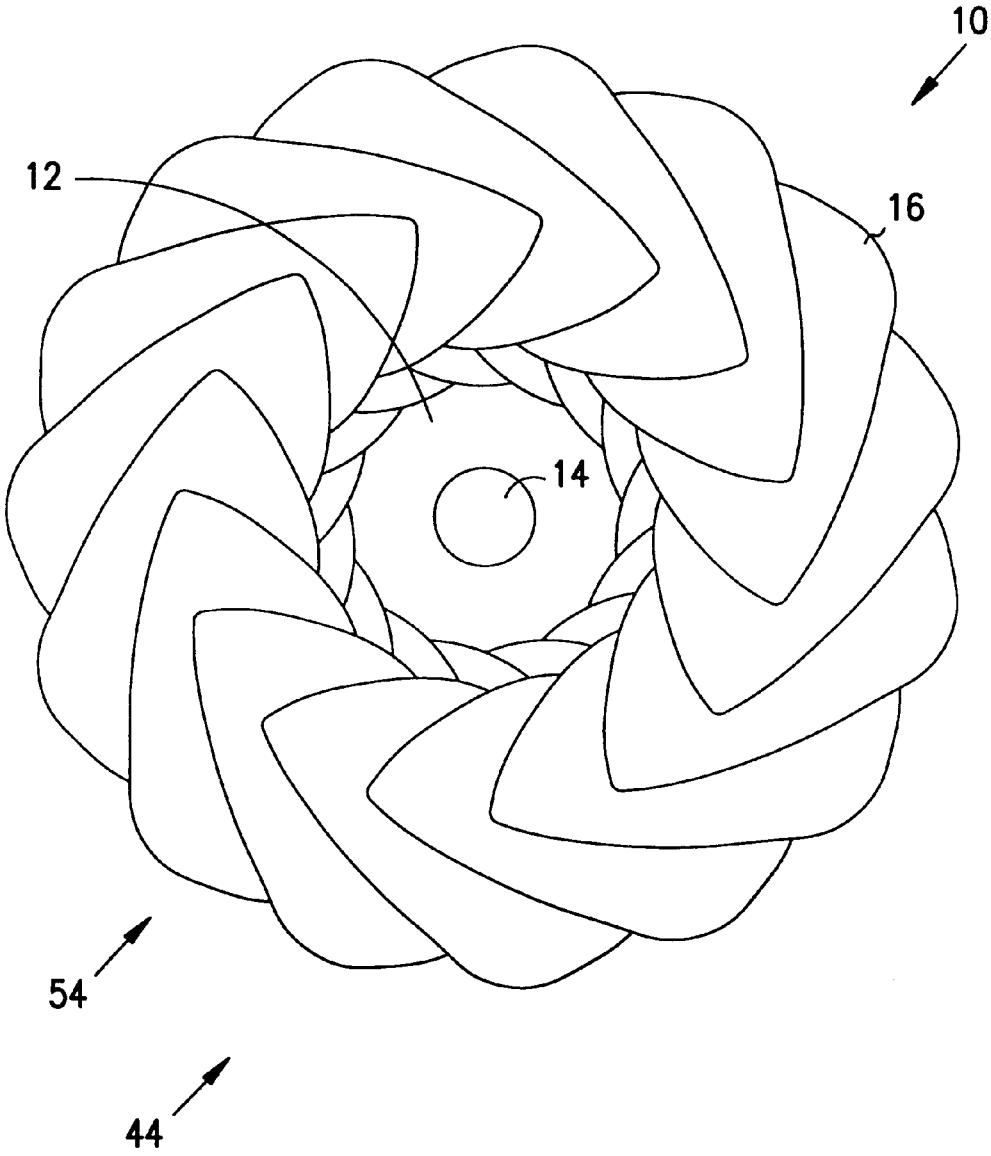
FIG. 7 is a side front view of one embodiment of a collapsible paraboloid dish in a second intermediate partially open position.
Figure 8:
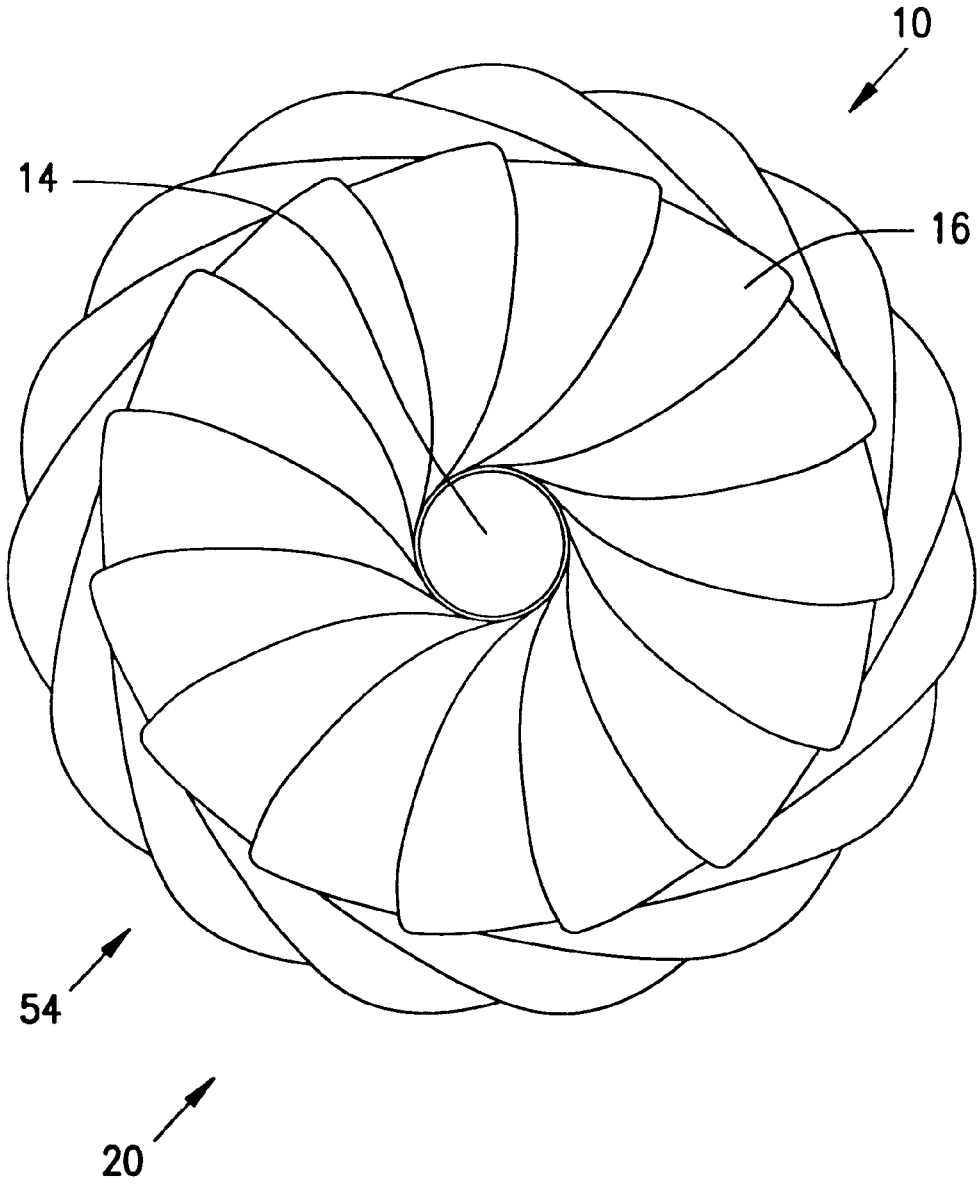
FIG. 8 is a side front view of one embodiment of a collapsible paraboloid dish in a fully closed position.

FIG. 5 through FIG. 8 show an exemplary receiving dish in a range of positions from open position 18 in FIG. 5 to closed position 20 in FIG. 8 with FIG. 6 showing a first intermediate position 42 and FIG. 7 showing a second intermediate position 44. The receiving dish 10 maintains a substantially parabolic shape and remains operational throughout the range of positions.

Each of FIGS. 5–8 show an exemplary embodiment of receiving dish 10 having a base 12, a receiver 14, and a plurality of petals 16. Each of the petals 16 are pivotably connected to the base 12 with a fastener 46. (Base 12 and fastener 46 not shown in FIG. 8). Fastener 46 is shown as a plastic pin with a flat head on the inside of receiving dish 10. However, fastener 46 is alternatively any fastener allowing the petal 16 to pivot from open position 18 to the closed position 20. Fastener 46 also provides a position stop 48 for an adjacent petal 50. In open position 18, adjacent petal 50 is stopped from pivoting past the open position 18 by the fastener 46. Each of the petals 16 has a notch 52 that is positioned so that the petal 16 may pivot about 180 degrees from open position 18 to the closed position 20. Notch 52 provides clearance for the receiver 14 to allow the petal 16 to rotate to closed position 20. Each of the petals 16 overlap an adjacent petal 50 to provide a continuous reflector 54 through out the range of positions. Receiving dish 10 is shown with fifteen petals. More petals may be used with increased cost or as few petals as fourteen may be used before gaps begin to appear between the petals at intermediate positions 42, 44 of receiving dish 10.

Figure 9:
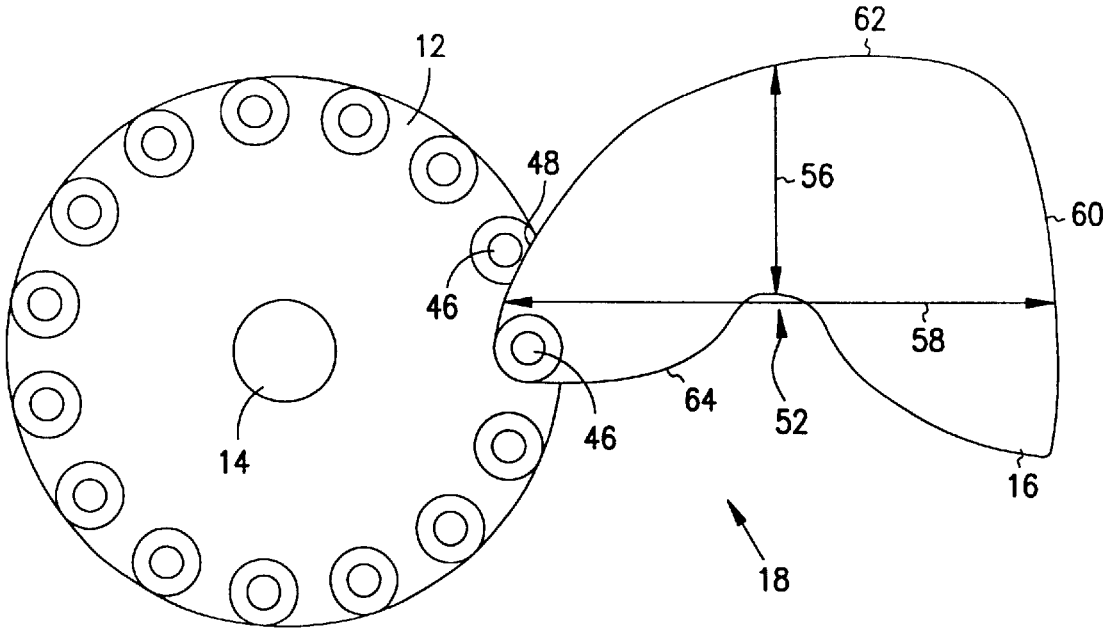
FIG. 9 is a partial front view of one embodiment of a collapsible paraboloid dish showing a single petal in an open position.
Figure 10:
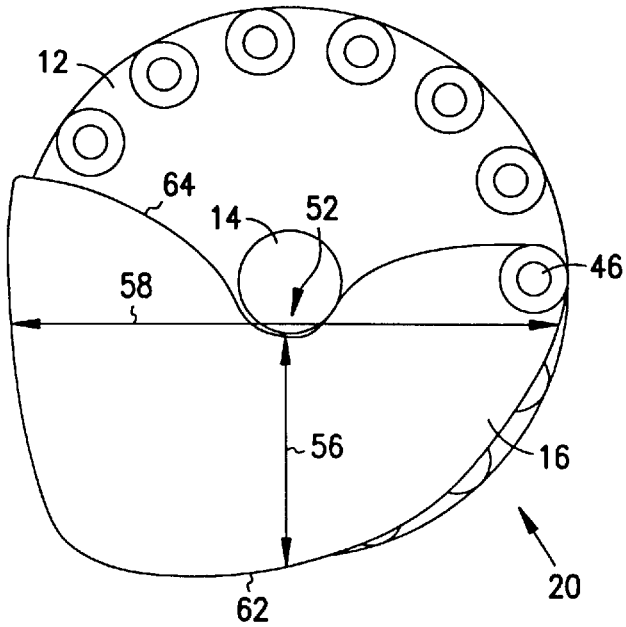
FIG. 10 is a partial front view of one embodiment of a collapsible paraboloid dish showing a single petal in a closed position.

FIG. 9 and FIG. 10 show an exemplary petal 16 connected to base 12. FIG. 9 shows petal 16 in open position 18 and FIG. 10 shows petal 16 in closed position 20. Each petal 16 is comprised of plastic, such as polyethylene or polypropylene and is about 0.0030 to about 0.0040 inches thick, which is an approximate lower limit for thinness using injection molding. Alternatively, petal 16 is comprised of other higher cost materials such as stainless steel or film plastics which are thinner and have less memory allowing a deeper receiving dish with a lower focus depth to diameter ratio. Petal 16 has a short dimension 56 and a long dimension 58. Long dimension 58 is from fastener 46 to the outside edge 60 of petal 16 and short dimension 56 transverses long dimension 58 running from a first side edge 62 to the a second side edge 64. First side edge 62 rests against fastener 46 and position stop 48 when petal 16 is in open position 18. Each petal 16 has notch 52 located along second side edge 64 of petal 16 about midway between the fastener 56 and outside edge 60 of petal 16. Notch 52 is sized to receive receiver 14 when petal 16 is closed position 20.

Figure 11:
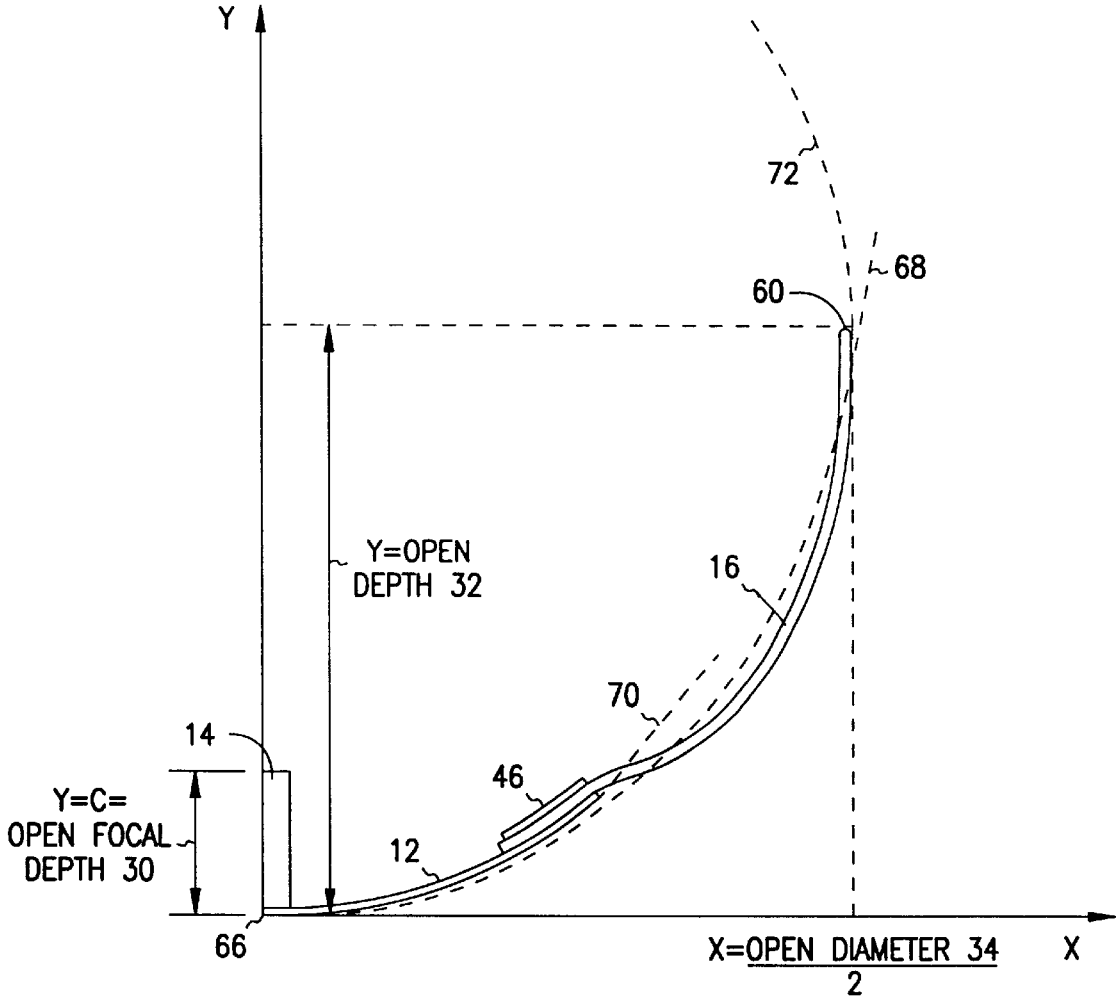
FIG. 11 is a cross sectional view of one embodiment of a collapsible paraboloid dish showing a single petal in a open position.

FIG. 11 shows a partial cross sectional view of an exemplary receiving dish 10 in open position 18. The vertex 66 of receiving dish 10 is placed on the origin of the x-y axis so that a parabolic curve 68 is defined by the equation $x^2=4cy$, where c is equal to the focal depth of parabolic curve 68. Receiving dish 10 has a substantially parabolic shape with base 12 and petal 16 substantially following the parabolic curve 68. The outside edge 60 of the petal is at a point substantially on the parabolic curve 68 where y=open depth 32, x=open diameter 32 divided by 2, and c=open focal depth 30.

The curvature 70 of base 12 uses a profile of a parabola that is about 20% narrower in diameter based upon the same depth. This achieves tensioning of the individual petals 16 with each other throughout their travel.

The first curvature 72 of petal 16 in the long dimension 58 approximates a sphere curvature of a diameter corresponding to open diameter 34. This helps provide tension between the petals in the open position 18.

Figure 12:
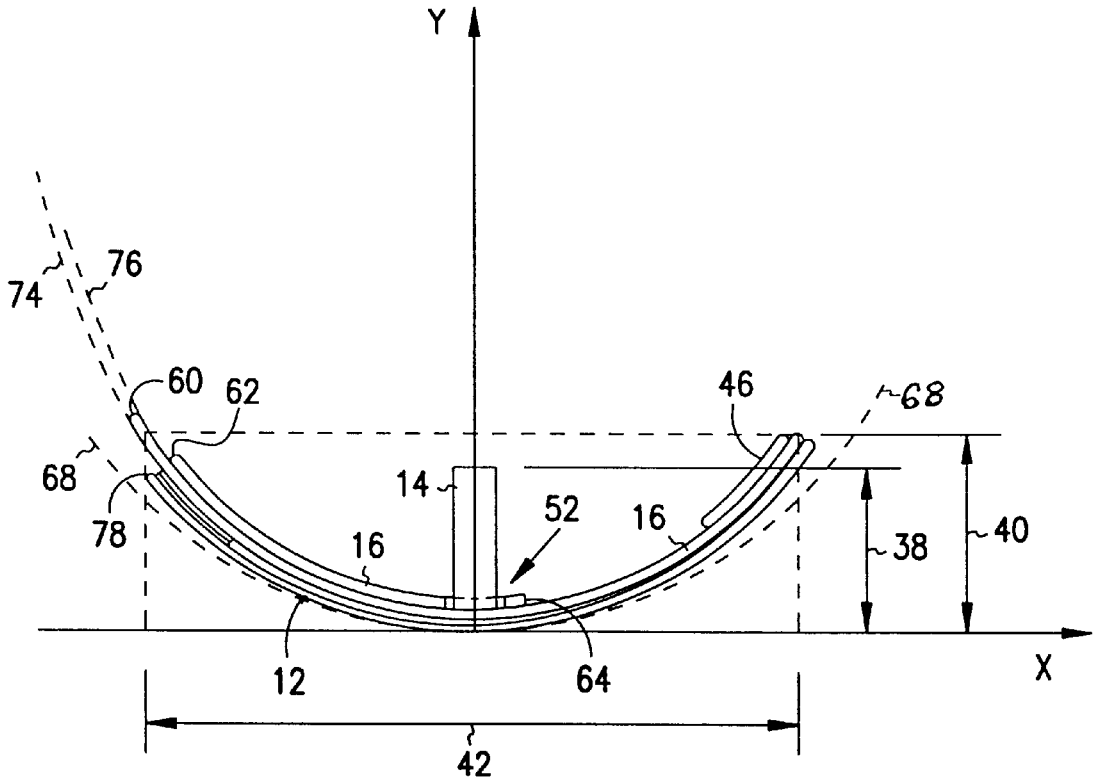
FIG. 12 is a cross sectional view of one embodiment of a collapsible paraboloid dish showing a single petal in a closed position.

FIG. 12 shows a partial cross section of an exemplary receiving dish 10 in closed position 20. The vertex 66 of receiving dish 10 is placed on the origin of the x-y axis so that parabolic curve 68 is defined by the equation $x^2=4cy$, where c is equal to focal depth of parabolic curve 68. Receiving dish 10 has a substantially parabolic shape with base 12 and petal 16 substantially following the parabolic curve 68. The outside edge 60 of the petal is at a point substantially on the parabolic curve 68 where y=closed depth 40, x=closed diameter 42 divided by 2, and c=closed focal depth 38.

Petal 16 flexes to a deflected curvature 74 to accommodate the different curvatures between open position 18 and closed position 20.

Petal 16 also has a second curvature 76 in short dimension 56 that is a degenerate parabolic section. The second curvature 76 is degenerate in that second curvature 76 is reduced or flatter than a parabolic curve. The second curvature 76 achieves better tension of receiving dish 10 in open position 18, and allows petals 16 to more easily lie on top of each other in closed position 20.

In one embodiment, open diameter 34 is about 8 inches and closed diameter 42 is about 4.5 inches. Open diameter is about two times as large as closed diameter. Open depth 32 is about 3 inches and closed depth is about 1 inch. Open depth is about three times as large as closed depth 40. Open focal depth 30 is about 1.25 inches, about the same as closed focal depth 38. The ratio of focal distance to diameter in open position 18 is about 0.16 and the ratio of focal distance to diameter in closed position 20 is about 0.28.

Alternatively, the closed position 20 is adjusted to a larger closed diameter 42 resulting in a ratio of focal distance to diameter of 0.25 or greater.

The maximum change in depth and diameter occurs if in the closed position, the outside edge of the petal is at the outer perimeter 78 of the base 12 resulting in the open diameter about 2.5 times larger than the closed diameter and the open depth about 6 times larger than the closed depth.

The diameter and depth of the receiving dish 10 are adjustable throughout the range of positions between open position 18 and closed position 20. Adjusting the diameter and depth of receiving dish 10 also adjusts the gain of receiving dish 10 so that the gain may be adjusted during operation by adjusting the depth and diameter.

An exemplary method of adjusting a receiving antennae includes providing a parabolic shaped antennae comprising a plurality of petals and adjusting the depth and diameter of the antennae by repositioning the plurality of the petals. One exemplary method further includes adjusting the gain of the antennae by repositioning the plurality of petals.

Another exemplary method further provides that each of the plurality of petals are pivotably connected to a base and moveable between an open position and a closed position. In the open position, the base and plurality of petals form a first reflector having a substantially parabolic shape. In the closed position the base and the plurality of petals form a second reflector having a substantially parabolic shape. Another exemplary method further provides operating the antennae in the open position, the closed position and throughout the range of positions between the open position and the closed position.

Advantageously, the collapsible deep paraboloid receiving dish allows for easier manufacture and shipping. The collapsible dish is operable in both the open and closed position and has an adjustable diameter and depth and an adjustable gain of the receiver.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A receiving dish comprising:

a base;

a receiver coupled to the base;

a plurality of petals, each of the plurality of petals pivotably connected to the base and moveable between an open position and a fully closed position;

wherein in the open position the base and plurality of petals form a first reflector having a substantially parabolic shape; and wherein in the fully closed position the base and the plurality of petals form an operational second reflector having a substantially parabolic shape.

2. The dish of claim 1 wherein the base and the plurality of petals form a substantially parabolic shape throughout a range of positions between the open position and the fully closed position.

3. The dish of claim 1 wherein the base, receiver, and plurality of petals are operable in the open position, the fully closed position and throughout the range of positions between the open position and the fully closed position.

4. The dish of claim 1 wherein the first reflector has a focal depth, a diameter, and a ratio of the focal depth to the diameter, wherein the ratio is less than about 0.25.

5. The dish of claim 4 wherein the second reflector has a focal depth, a diameter, and a ratio of the focal depth to the diameter, wherein the ratio is less than about 0.25.

6. The dish of claim 1 wherein the base has a curvature, a depth, and a diameter, wherein the curvature of the base is narrower than a curvature of each petal.

7. The dish of claim 1 wherein the first reflector has a first diameter and the second reflector has a second diameter, wherein the first diameter is up to about 2.5 times larger than the second diameter.

8. The dish of claim 1 wherein the first reflector has a depth and the second reflector has a depth, wherein the first depth is up to about 6 times the second depth.

9. The dish of claim 1 wherein the first reflector has a first diameter and a first depth and the second reflector has a second diameter and a second depth, wherein the first diameter is up to about 2 times larger than the second diameter and the first depth is up to about 3 times larger than the second depth.

10. The dish of claim 1 wherein the plurality of petals comprise at least 14 petals.

11. The dish of claim 1 further comprising a plurality of fasteners, each of the fasteners pivotably connecting one of the plurality of petals to the base.

12. The dish of claim 11 wherein each of the fasteners is positioned such that each fastener provides a stop for an adjacent petal.

13. A receiving dish comprising:

a base;

a receiver coupled to the base for receiving signals;

a plurality of petals, each of the plurality of petals being pivotably connected to the base and moveable between an open position and a fully closed position;

wherein in the open position the base and plurality of petals form a first reflector having a substantially parabolic shape;

wherein each of the petals overlaps an adjacent petal in the open position and wherein each of the petals overlaps the base in the fully closed position such that the base provides tension to the plurality of petals in the fully closed position and the receiving dish remains operational between the open position and the fully closed position.

14. The dish of claim 13 wherein in the fully closed position the base and the plurality of petals form a second reflector having a substantially parabolic shape.

15. The dish of claim 13 wherein each of the plurality of petals is comprised of plastic.

16. The dish of claim 13 wherein each of the plurality of petals is comprised of a plastic from the group of polyethylene and polypropylene.

17. The dish of claim 13 wherein the each of the plurality of petals have a thickness of about 0.0030 to about 0.0040 inch.

18. The dish of claim 13 wherein each of the plurality of petals has a first curvature along a long dimension of each of the plurality of petals.

19. The dish of claim 18 wherein the first curvature approximates a sphere curvature.

20. The dish of claim 13 wherein each of the plurality of petals has a second curvature along a short dimension of each of the plurality of petals.

21. The dish of claim 20 wherein the second curvature is less than the first curvature.

22. The dish of claim 21 wherein the second curvature provides tension between each of the plurality of petals.

23. The dish of claim 22 wherein the second curvature allows the petals to overlap each other in the fully closed position.

24. The dish of claim 13 wherein each of the plurality petals overlaps two adjacent petals.

25. The dish of claim 13 wherein each of the plurality of petals comprise a notch, the notch positioned along an edge of each of the plurality of petals to receive the receiver in the fully closed position.

26. The method of adjusting a receiving antennae comprising:

providing a parabolic shaped antennae comprising a plurality of petals; and adjusting the depth and diameter of the antennae by repositioning the plurality of petals while maintaining a substantially parabolic shape of the parabolic shaped antennae;

wherein each of the plurality of petals are pivotably connected to a base and moveable between an open position and a fully closed position, wherein in the open position the base and plurality of petals form a first reflector having a substantially parabolic shape, and wherein in the fully closed position the base and the plurality of petals form a second reflector having a substantially parabolic shape; and operating the antennae in the open position, the fully closed position and throughout the range of positions between the open position and the fully closed position.

27. The method of claim 26 further comprising adjusting the gain of the antennae by repositioning the plurality of petals.

28. The method of claim 26 wherein operating the antennae in the fully closed position includes engaging a notch positioned along an edge of each of the plurality of petals with a receiver.

29. A receiving dish comprising:

a base;

a receiver coupled to the base;

a plurality of petals, each of the plurality of petals pivotably connected to the base and moveable between an open position and a closed position;

wherein in the open position the base and plurality of petals form a first reflector having a substantially parabolic shape; and wherein each of the plurality of petals comprise a notch, the notch positioned along an edge of each of the plurality of petals to receive the receiver in the closed position.

30. The dish of claim 29 wherein the base and the plurality of petals form a substantially parabolic shape throughout a range of positions between the open position and the closed position.

31. The dish of claim 29 wherein the base, receiver, and plurality of petals are operable in the open position, the closed position and throughout the range of positions between the open position and the closed position.

* * * * *

UNITED STATES PATENT AND TRADEMARK OFFICE

CERTIFICATE OF CORRECTION

PATENT NO. : 6,625,288 B1
DATED : September 23, 2003
INVENTOR(S) : David H. Koizumi It is certified that error appears in the above-identified patent and that said Letters Patent is hereby corrected as shown below:

Column 6,
Lines 8-9, delete "such that the base provides tension to the plurality of petals in the fully closed position" after "position"

Signed and Sealed this

Third Day of August, 2004

JON W. DUDAS
*Acting Director of the United States Patent and Trademark Office*